US006778470B1

(12) United States Patent
Monahan et al.

(10) Patent No.: US 6,778,470 B1
(45) Date of Patent: Aug. 17, 2004

(54) MOUNTABLE SYNTACTIC FOAM SENSOR HOUSING

(75) Inventors: Patrick J. Monahan, Gales Ferry, CT (US); Robert S. Janus, Middletown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/663,057

(22) Filed: Sep. 15, 2003

(51) Int. Cl.[7] ..... H04R 17/00; H04R 1/28
(52) U.S. Cl. ..... 367/188; 367/141; 367/153
(58) Field of Search ..... 367/141, 153, 367/176, 188; 73/649; 310/337

(56) References Cited

U.S. PATENT DOCUMENTS 3,601,789 A * 8/1971 Sullivan et al. ..... 367/153
4,674,595 A 6/1987 Henriquez
H391 H 12/1987 Henriquez et al.
5,363,342 A 11/1994 Layton et al.
5,646,470 A 7/1997 de Groot
5,671,191 A 9/1997 Gerdt
6,226,227 B1 5/2001 Lent et al.
6,314,811 B1 * 11/2001 Goldner et al. ..... 367/188

* cited by examiner

*Primary Examiner*—Ian J. Lobo
(74) *Attorney, Agent, or Firm*—James M. Kasischke; Michael P. Stanley; Michael F. Oglo

(57) ABSTRACT

A encapsulation method of an acoustic sensor module and a resultant lightweight watertight acoustic sensor module for use in towed array retrieval systems. In the method, a composite is cast to encapsulate the support between end plates of the module, an exterior of a passage tube in which the array is retrieved, transducers positioned on the tube exterior and supporting telemetry lines for the transducers. The components, listed previously, are cast into a block of the cured composite such that the arrangement of the components is fixed. Residual composite emitting from an aperture of an end plate allows a conductor for the telemetry lines to be potted into the composite with an end of the conductor free from the composite thereby allowing connection to an external controller or generator.

10 Claims, 6 Drawing Sheets

MOUNTABLE SYNTACTIC FOAM SENSOR HOUSING

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The field to which this invention relates is hull mounted acoustic sensor modules for towed array handling systems.

(2) Description of the Prior Art

During some submarine operations, a towed array for underwater acoustic reception extends by tow cable from the hull of the submarine. After use, the towed array is retrieved using an exterior retrieval system. Since the retrieval system is exterior to the submarine hull or otherwise separated from direct access by submarine personnel, acoustic sensors are used to detect retrieval of the towed array.

Typically, the acoustic sensors surround a passage tube in which the towed array is retrieved through a water-filled inner volume of the passage tube. The basic sensor design consists of an acoustic projector and a receiver. These two units are typically positioned on opposite sides of the passage tube. The projector transmits an acoustic beam which is detected by the receiver. The difference in signal level detected by the receiver when the towed array is/is not between the projector and receiver is used to determine when the array has been completely retrieved.

The acoustic sensors surrounding the passage tube are encased in a copper-nickel housing in order to position the sensors. The housing also provides a watertight enclosure that prevents exterior water from reaching the sensors and the interior components. Exterior water, typically in the form of seawater, can damage the sensors by corrosion or by the electrical conductivity associated with seawater. As such, the module must be water-resistant as possible and optimally watertight. For a metal module, a watertight condition requires multiple o-rings at the apertures and connection points of the module. However, the use of multiple o-rings increases the likelihood of problems associated with o-rings such as unpredictable failure and increasing replacement costs.

Also, because most sensors and their support components require periodic maintenance, the metal housing containing the sensors must be removed from the submarine and accessed. Since a metal module and interior housing is heavy and awkward for handling underwater, the module is often difficult for divers to remove and re-position during maintenance.

SUMMARY OF THE INVENTION

Accordingly, it is a general purpose and primary object of the present invention to provide a watertight acoustic sensor module for detecting when a towed array has been fully retrieved by its handling system in which the acoustic sensor module maintains it watertight integrity without the use of o-rings It is a further object of the present invention to provide a light-weight watertight acoustic sensor module.

It is a still further object of the present invention to provide a watertight acoustic sensor module of easy fabrication and relatively low cost.

To attain the objects described there is provided a composite encapsulation method for an acoustic sensor module and a resultant lightweight watertight acoustic sensor module for towed array handling systems.

Prior to encapsulation, the component structure of the acoustic sensor module generally comprises two end plates removably connected by support posts to each other in which the end plates encompass a passage tube. Four transducers are attached to the passage tube at positions equidistant from each other on the circumference of the passage tube.

Each of the transducers is attached to the passage tube by a semi-rigid adhesive with an acoustic window that allows an acoustic beam to be transmitted from a piezoelectric ceramic element of two transducers onto the passage tube. A backing plate of the transducers further directs the acoustic beam to the passage tube. For the other two transducers, the acoustic window of the adhesive allows an acoustic beam to be received from the passage tube by the piezoelectric ceramic element of the transducers.

Telemetry lines from the transducers are conductive to an electrical conductor fitted in an aperture of one of the two end plates. The electrical conductor is attachable to an external signal generator that drives the two acoustic projectors and to a circuit that monitors the output levels of the acoustic recievers.

In the composite encapsulation method, an epoxy composite is injected into a cast. The epoxy composite is injected to encapsulate the support posts, the exterior of the passage tube, the transducers and the telemetry lines of the acoustic sensor module. A resin with micro-spheres is added to further lighten the weight of the acoustic sensor module. Once the epoxy composite with a micro-sphere resin is mixed, hollow glassine macro-spheres are added to the composite such that a composite with a syntactic construction results. The syntactic composite, in addition to being lighter than the epoxy composite, is also highly resistant to external pressure and impact forces.

The components, listed above, of the acoustic sensor module can be cast into a resultant light-weight block of the epoxy composite with or without micro-spheres and macro-spheres. The casting sets the arrangement of the components thereby minimizing vibration of the components.

The residual epoxy composite or syntactic composite emitting from the aperture of the end plate allows the electrical conductor to be potted directly into the composite thereby eliminating the need for sealing O-rings and reducing the chances of water penetration. Additionally, the need for tooling the acoustic sensor module to allow O-ring placement is eliminated, thereby greatly reducing the cost of fabrication.

The above and other features of the invention, including various and novel details of construction and combinations of parts will now be more particularly described with reference to the accompanying drawings and pointed out in the claims. It will be understood that the particular devices embodying the invention are shown by way of illustration only and not as the limitations of the invention. The principles and features of this invention may be employed in various and numerous embodiments without departing from the scope of the invention.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
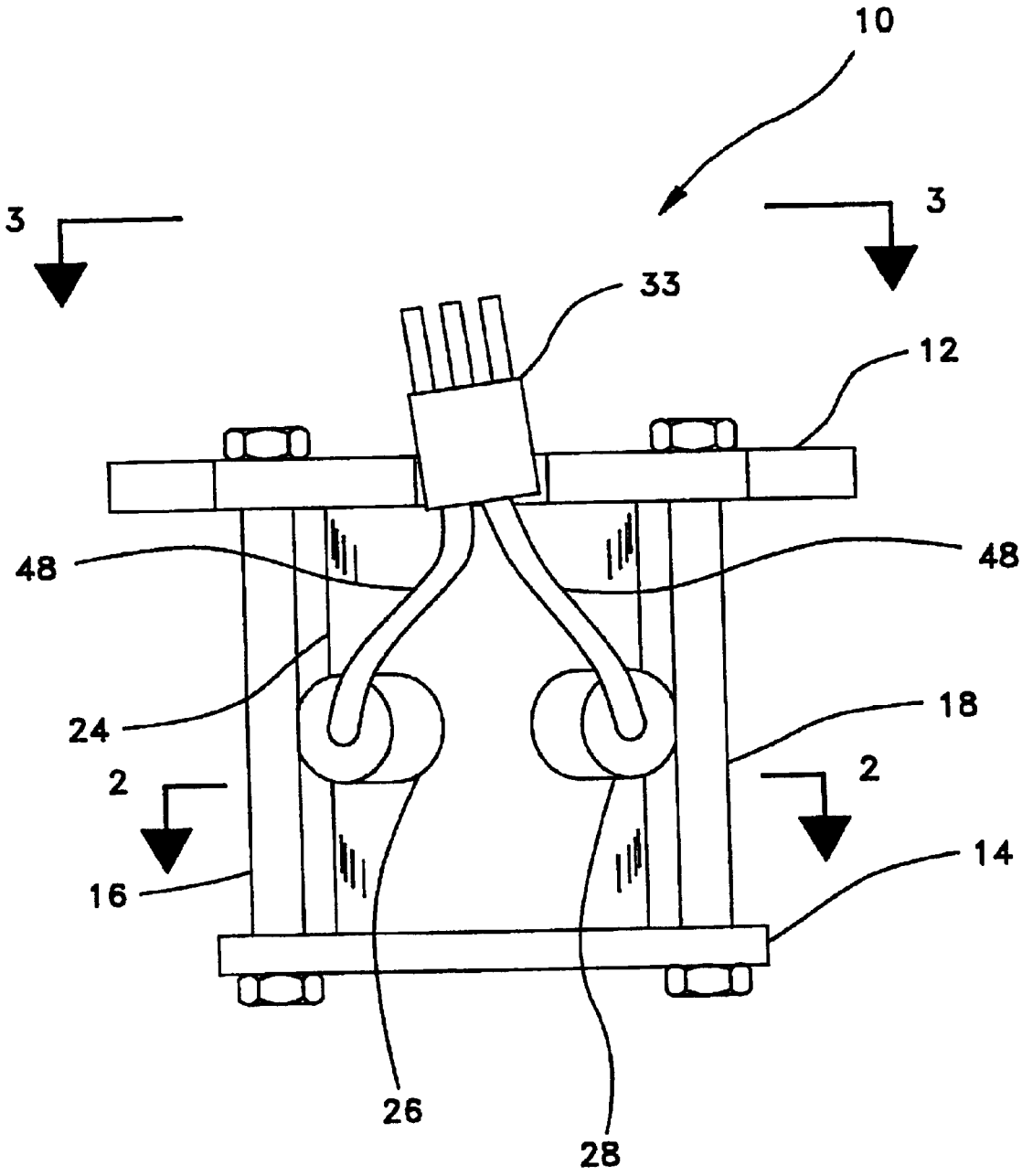
FIG. 1 is a side view of the acoustic sensor module of the present invention with the composite section and macro-spheres removed for the purpose of depicting a clarified view of the sensor geometry.
Figure 2:
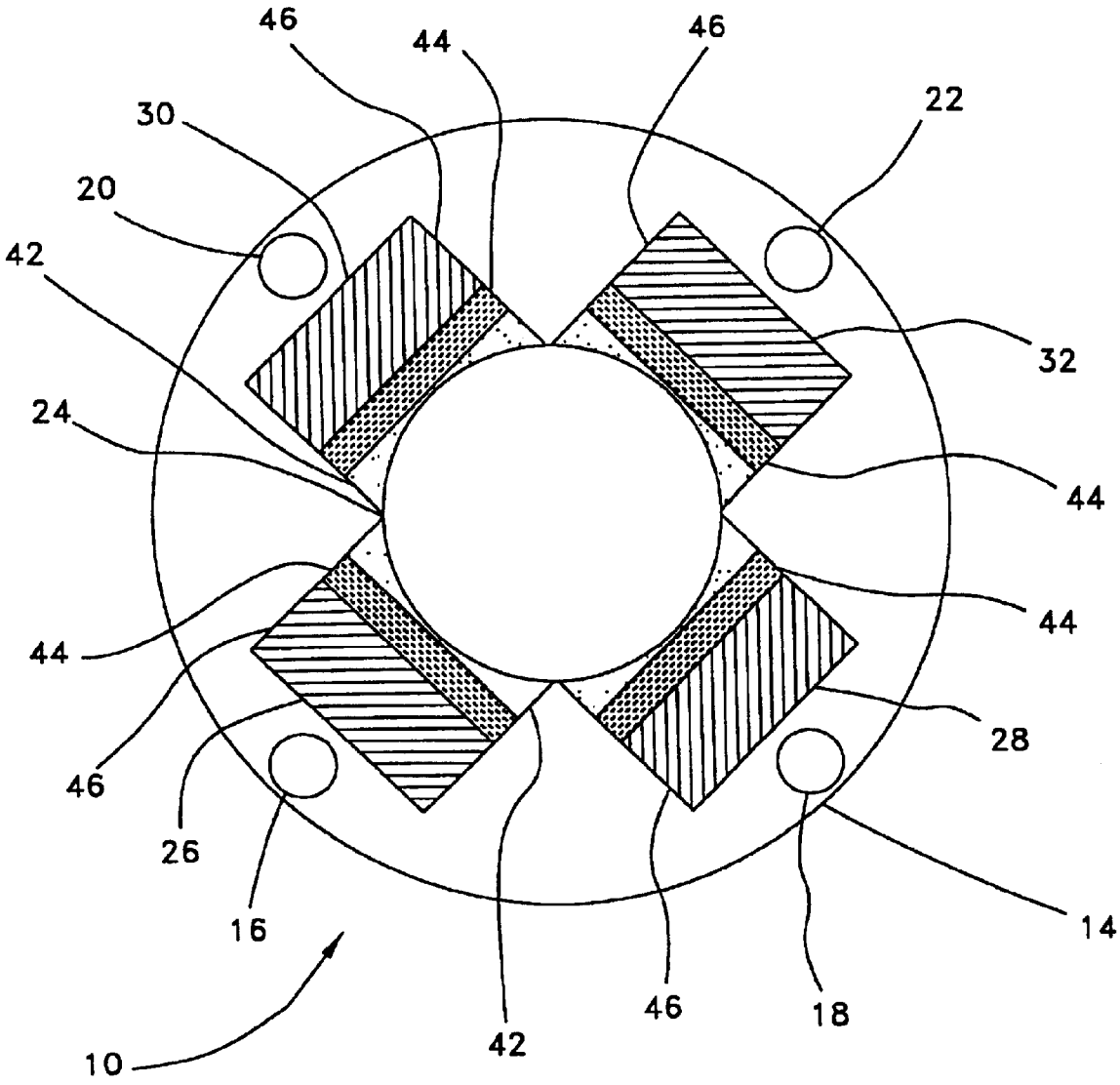
FIG. 2 is a plan view of the acoustic sensor module of the present invention with the epoxy section and macro-spheres removed for the purpose of depicting an alternative clarified view of the sensor geometry, with the view taken from reference line 2—2 of FIG. 1.

Referring now to the drawings wherein like numerals refer to like elements throughout the several views, one sees that FIGS. 1 and 2 depict the acoustic sensor module 10 of the present invention. The module 10 generally comprises the components of two end plates 12, 14 connected to each other by support posts 16, 18, 20 and 22 which encompass a passage tube 24. Four transducers 26, 28, 30 and 32, with an electrical conductor 33, are attached to a passage tube 24 at positions equidistant from each other on the circumference of the passage tube.

Each of the transducers 26, 28, 30 and 32 is attached to the passage tube 24 by a semi-rigid adhesive, such as polyurethane. Polyurethane is preferred in that the material is acoustically transparent as an acoustic window 42 for a piezoelectric ceramic element 44. The acoustic window 42 allows an acoustic beam to be transmitted from the piezoelectric ceramic element 44 of the transmit transducers 26 and 28 onto the passage tube 24. A backing plate 46 of the actuated transducers 26 and 28 further directs the acoustic beam to the passage tube 24.

For the recieve transducers 30 and 32, the acoustic window 42 allows an acoustic beam to be received from the passage tube 24 by the piezoelectric ceramic element 44 of the transducers. The backing plate 46 of the transducers 30 and 32 further enhances the acoustic beam from the passage tube 24 to the piezoelectric ceramic element 44. The operation of the transducers 26, 28, 30 and 32 during a towed array retrieval is discussed in further detail below.

The transducers 26 and 28 are wired together in parallel with telemetry lines 48 and as stated above, and perform as acoustic projectors which transmit acoustic beams into the passage tube 24. The transducers 30 and 32 are also wired together in parallel by another set of the telemetry lines 48 and as stated above perform as hydrophones which receive the acoustic beams of the transducers 26 and 28. The telemetry lines 48 are conductive to the electrical conductor 33 fitted in an aperture 34 of the end plate 12. (See FIG. 3) The electrical conductor 33 is attachable to a signal generator 60 and to a receive signal circuit 62 which are depicted diagrammatically in FIG. 4.

Figure 3:
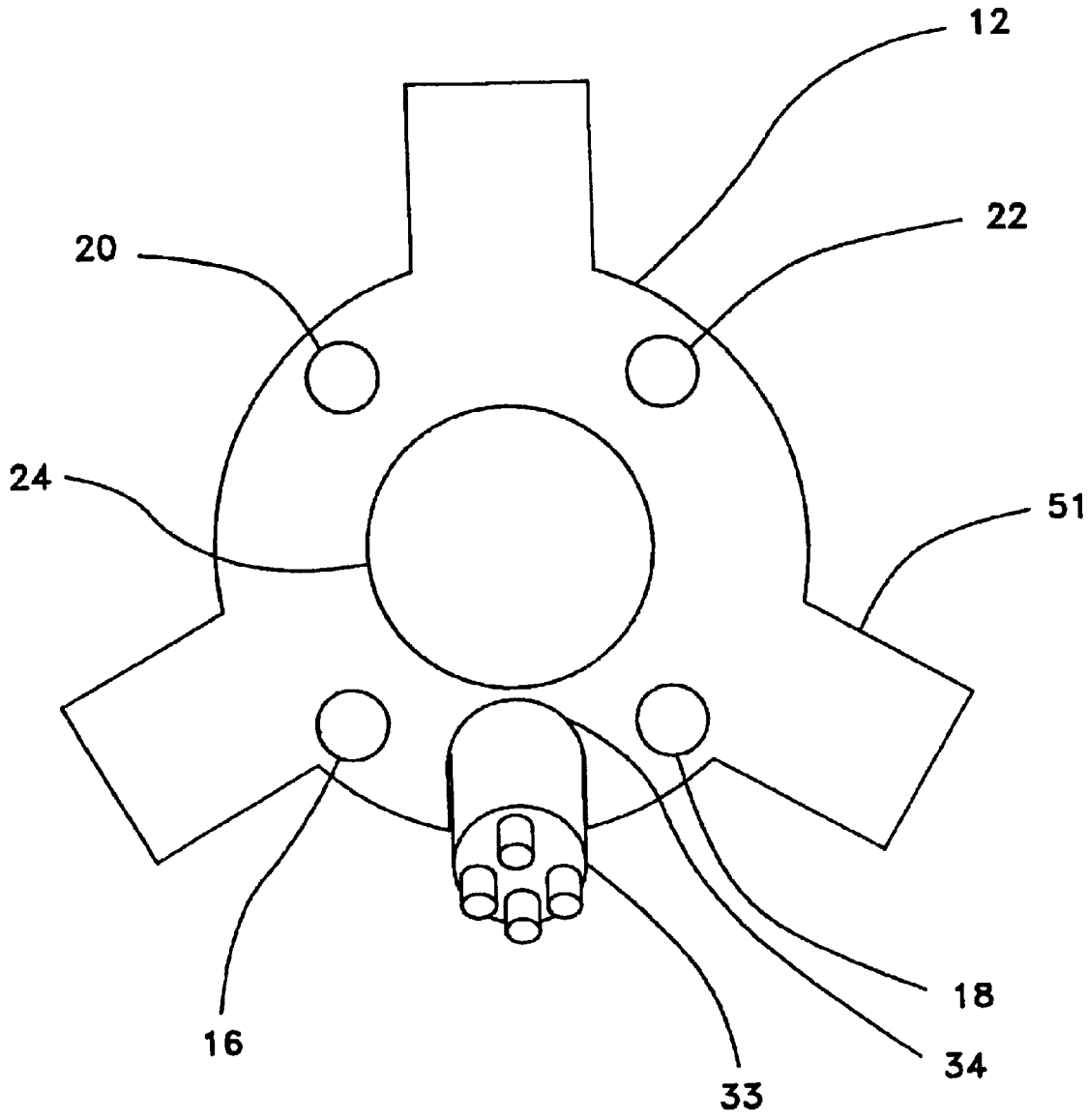
FIG. 3 is a plan view of the end plate of the acoustic sensor module of the present invention, with the view taken from reference line 3—3 of FIG. 1.

As shown in FIG. 3, the end plate 12 is suitably designed for mounting in a submarine. The thickened semi-circular end plate 12 includes three protruding guides 51 sized to fit slots within the mounting structure of the submarine (not shown).

Figure 4:
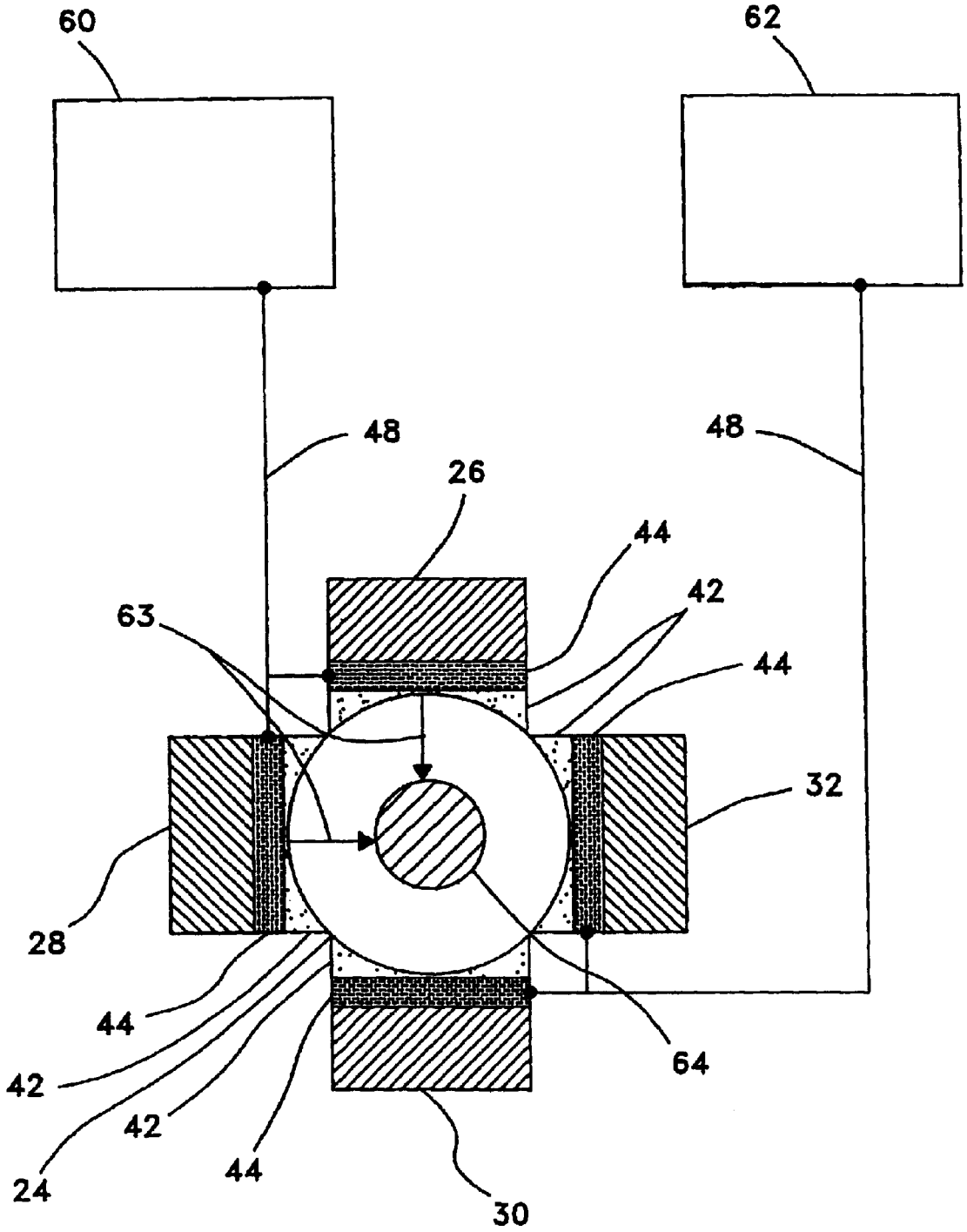
FIG. 4 is a diagram of the operation of the acoustic sensor module of the present invention.

Referring again to the diagram of FIG. 4 for the operation of the acoustic sensor module 10, the signal generator 60, such as an oscilloscope, transmits a continuous wave (CW) signal over the telemetry lines 48 to actuate the transducers 26 and 28. The piezoelectric ceramic elements 44 of the transducers 26 and 28 vibrate in response to the continuous wave signal. The vibration of the piezoelectric ceramic elements 44 projects an acoustic beam through the acoustic window 42 and into an inner volume of the passage tube 24. Since the transducers 26 and 28 are perpendicular to each other, a cross-beam pattern 63 that includes the single beams of both transducers is formed in the passage tube 24. As a towed array cable 64 is retrieved in a water column of the passage tube 24, the cross-beam pattern 63 is partially deflected by the towed array cable and is received as partially deflected by the hydrophone capacity of the transducers 30 and 32.

When the acoustic energy of the partially-deflected cross-beam pattern 63 is received by the piezo-ceramic elements 44 of the transducers 30 and 32, the acoustic energy is converted to electrical energy. The voltage of the electrical energy produced by the piezoelectric ceramic elements is transmitted to the receive signal circuit 62. The predetermined voltage received by the receive signal circuit 62 indicates whether or not a towed array is present in the passage tube 24.

During a towed array retrieval, the receive signal circuit 62 signals a winch (not shown) to keep pulling in the towed array as long as the predetermined voltage is received by the controller. When the end of the towed array has continued past the transducers 26, 28, 30 and 32, a full or non-deflected cross-beam pattern is transmitted through the passage tube 24 and is received by the transducers 30 and 32. The acoustic energy of the full or non-deflected beam received by the piezoelectric ceramic elements 44 of the transducers 30 and 32 and the resultant voltage transmitted by the piezoelectric ceramic elements 44 is received by the receive signal circuit 62. The resultant voltage indicates that the towed array is no longer present in the passage tube 24 which prompts the receive signal circuit 62 to stop the winch and to stop retrieval of the towed array.

Figure 5:
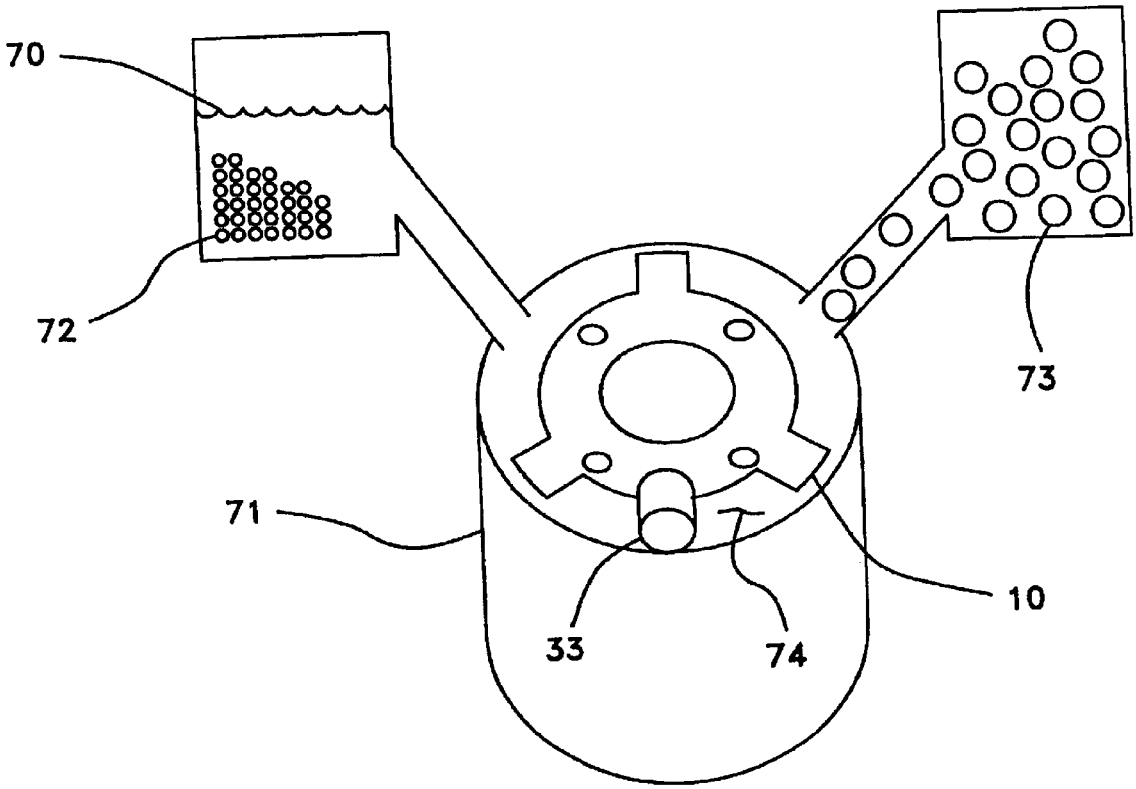
FIG. 5 is a perspective view of the acoustic sensor module of the present invention depicting the addition of encapsulating composite and macro-spheres.

In the composite encapsulation method of the acoustic sensor module 10 shown in FIG. 5, an epoxy composite 70, is injected into a cast 71. The epoxy composite 70 is injected into the cast 71 to encapsulate the support posts 16, 18, 20 and 22; the exterior of the passage tube 24; the transducers 26, 28, 30 and 32; and the telemetry lines 48 of the acoustic sensor module 10. The epoxy composite 70 preferred for casting is LORD 305 epoxy. LORD 305 epoxy is identifiable by the its ability to mix with resin micro-spheres 72 which contain hollow microspheres which contribute to its light weight. Other suitable substitutes of epoxy, known to those ordinarily skilled in the art, may be used; however, differences in texture and weight may be encountered such that different casting methods may be required.

Figure 6:
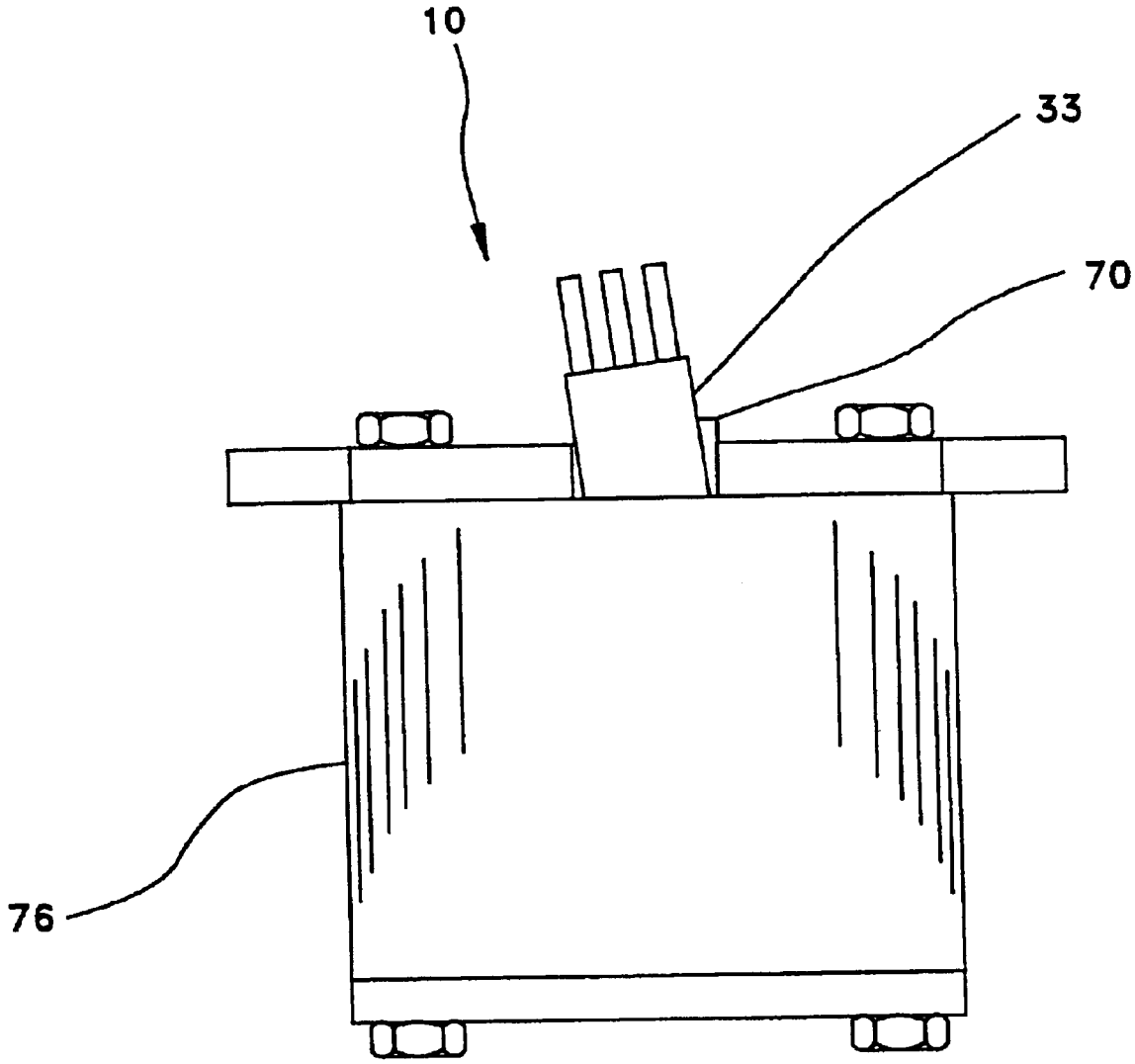
FIG. 6 is a side view of the acoustic sensor module of the present invention fully assembled.

Once a epoxy composite 70 with the resin micro-spheres 72 is mixed, hollow glassine macro-spheres 73 are added to the composite such that a composite 74 with a syntactic construction results. The syntactic composite 74, in addition to being lighter than the epoxy composite 70, is also highly resistant to the pressure and impact forces. The components, listed above, of the acoustic sensor module 10 are cast into a resultant light-weight block 76 of the epoxy composite 70 with or without micro-sphere resin 72 and macro-spheres 73. See FIG. 6 The light-weight block 76 sets the arrangement of the components in place.

The residual epoxy composite 70 or syntactic composite 74 emitting from the aperture 35 of the end plate 12 allows the electrical conductor 33 to be potted directly into the composite thereby eliminating the need for sealing O-rings and reducing the chances of water penetration. Additionally, the need for tooling the acoustic sensor module 10 to allow O-ring placement is eliminated, thereby greatly reducing the cost of fabrication.

Accordingly, the epoxy casting of the acoustic sensor module 10 of the present invention provides a simple, inexpensive means for a significantly lightened acoustic sensor module with an enhanced water-tightness around its electrical components.

Thus by the present invention its objects and advantages are realized and although preferred embodiments have been disclosed and described in detail herein, its scope should be determined by that of the appended claims.

What is claimed is:

1. An underwater acoustic sensor module comprising:

a first end plate including an aperture;

a second end plate removably attached to said first end plate at a distance from said first end plate, said distance along an axis perpendicular to a face of said first end plate and to a face of said second end plate;

a tube positioned along said axis and passing through said first and second end plates;

a sensing system positioned on an exterior periphery of said tube;

a conductor with a first connection and a second connection, said conductor electrically conductive to said sensing system at said first connection and fittable to said first end plate aperture at said second connection; and a shell formed of a lightweight composite and positioned within said distance, wherein said shell encapsulates said tube, said sensing system and said conductor to said aperture.

2. The underwater acoustic sensor module in accordance with claim 1, wherein said sensing system comprises at least four transducers positioned along said exterior periphery of said tube;

wherein at least two of said transducers are hydrophones; and wherein at least two of said transducers are acoustic projectors.

3. The underwater acoustic sensor module in accordance with claim 2 wherein the positioning of said transducers includes polyurethane as an adhesive to said exterior periphery.

4. The underwater acoustic sensor in accordance with claim 3 wherein said lightweight composite comprises epoxy.

5. The underwater acoustic sensor in accordance with claim 4 wherein said lightweight composite further comprises a micro-sphere resin.

6. The underwater acoustic sensor in accordance with claim 5 wherein said lightweight composite further includes hollow macro-spheres.

7. The underwater acoustic sensor in accordance with claim 6 wherein said first end plate further comprises guide plates extending from the periphery of said first end plate, wherein said guide plates are mountable to a retrieval system for said acoustic sensor module.

8. A method of fabricating a lightweight watertight acoustic sensor module, said method comprising the steps of:

providing an assembly comprising a first end plate including an aperture, a second end plate removably attached to said first end plate at a distance from said first end plate and a passage tube within said distance and along an axis through said end plates;

adhering a sensing system to an exterior periphery of said passage tube;

fitting a conductor electrically conductive to said sensing system to said first end plate aperture;

surrounding the exterior dimensions of said assembly within said distance with a casting;

injecting a lightweight composite between said passage tube and said casting;

encapsulating said assembly with said composite within said distance;

curing said composite; and removing said casting to form said lightweight watertight acoustic sensor module.

9. The method in accordance with claim 8 wherein said method further comprises the step of adding a micro-sphere resin to said lightweight composite.

10. The method in accordance with claim 9 wherein said method further comprises the step of adding hollow macro-spheres to said lightweight composite.

* * * * *